US008419444B2

(12) United States Patent
Kagan et al.

(10) Patent No.: US 8,419,444 B2
(45) Date of Patent: Apr. 16, 2013

(54) ADAPTER FOR HIGH-SPEED ETHERNET

(75) Inventors: Michael Kagan, Zichron Yaakov (IL); Oren Tzvi Sela, Rosh Pina (IL); Yoram Zer, Yokneam (IL)

(73) Assignee: Mellanox Technologies Ltd., Yokneam (IL)

( * ) Notice: Subject to any disclaimer, the term of this patent is extended or adjusted under 35 U.S.C. 154(b) by 0 days.

(21) Appl. No.: 13/225,584

(22) Filed: Sep. 6, 2011

(65) Prior Publication Data

US 2012/0071011 A1 Mar. 22, 2012

Related U.S. Application Data

(60) Provisional application No. 61/383,343, filed on Sep. 16, 2010.

(51) Int. Cl.
*H01R 12/00* (2006.01)

(52) U.S. Cl.
USPC ..... 439/76.1

(58) Field of Classification Search ..... 439/76.1, 439/676, 638, 620.01–620.34, 607.2–607.21, 439/941
See application file for complete search history.

(56) References Cited

U.S. PATENT DOCUMENTS 4,968,260 A * 11/1990 Ingalsbe ..... 439/76.1
5,087,207 A 2/1992 Byrne
5,387,110 A * 2/1995 Kantner et al. ..... 439/59
5,664,950 A * 9/1997 Lawrence ..... 439/76.1
5,696,669 A * 12/1997 Bassler et al. ..... 361/816
5,734,558 A * 3/1998 Poplawski et al. ..... 361/752
5,766,020 A 6/1998 Hughes
5,788,521 A * 8/1998 Milan ..... 439/214
5,984,731 A * 11/1999 Laity ..... 439/676
6,183,307 B1 * 2/2001 Laity et al. ..... 439/676
6,183,308 B1 * 2/2001 Laity ..... 439/676
6,203,333 B1 * 3/2001 Medina et al. ..... 439/76.1
6,215,656 B1 * 4/2001 O'Neal et al. ..... 361/679.02
6,517,382 B2 * 2/2003 Flickinger et al. ..... 439/607.23
6,648,695 B1 11/2003 Wu
6,773,291 B1 * 8/2004 Roth et al. ..... 439/344
6,814,593 B2 * 11/2004 Wang et al. ..... 439/131
7,028,202 B2 4/2006 Long et al.
7,048,550 B2 * 5/2006 Hyland et al. ..... 439/67
7,335,033 B1 2/2008 Edwards, Jr. et al.
7,380,993 B2 * 6/2008 Dallesasse ..... 385/89
7,747,292 B2 * 6/2010 Mezer et al. ..... 455/570

(Continued)

OTHER PUBLICATIONS

Mellanox Technologies, "Quad to Serial Small Form Factor Pluggable Adapter: Enabling VPI/40GigE Connectivity on 1/10GigE Infrastructure", USA 2010.
SFF Committee, "INF-8438i Specification for QSFP (Quad Small Formfactor Pluggable) Transceiver", Revision 1.0, Nov. 2006.
Barrass et al, "10GBASE-T: 10 Gigabit Ethernet over Twisted-pair Copper", Ethernet Alliance, Version 1.0, Austin, USA, Aug. 2007.
Aquantia Corporation, Quad 10GBASE-T Product Brief, Version 1.0, Milpitas, USA, Apr. 23, 2009.

(Continued)

*Primary Examiner* — Amy Cohen Johnson
*Assistant Examiner* — Vladimir Imas
(74) *Attorney, Agent, or Firm* — D. Kligler I.P. Services Ltd.

(57) ABSTRACT

An adapter includes a mechanical frame, which is configured to be inserted into a SFP-type receptacle and contains a socket for receiving a plug of a twisted-pair-type cable. First electrical terminals, held by the mechanical frame, are configured to mate with a connector in the receptacle. Second electrical terminals, held within the socket, are configured to mate with electrical connections of the plug. Circuitry connects the first and second electrical terminals so as to enable interoperation of the plug with the receptacle.

12 Claims, 4 Drawing Sheets

U.S. PATENT DOCUMENTS

| | | | | |
|---|---|---|---|---|
| 7,823,041 | B2 * | 10/2010 | Mezer et al. | 714/752 |
| 7,934,959 | B2 | 5/2011 | Rephaeli et al. | |
| 8,083,417 | B2 * | 12/2011 | Aronson et al. | 385/92 |
| 2001/0019907 | A1 * | 9/2001 | Glad et al. | 439/131 |
| 2004/0013369 | A1 * | 1/2004 | Coffey et al. | 385/53 |
| 2004/0018774 | A1 | 1/2004 | Long et al. | |
| 2004/0023559 | A1 | 2/2004 | Wu | |
| 2005/0282442 | A1 * | 12/2005 | Hyland et al. | 439/676 |
| 2007/0232132 | A1 * | 10/2007 | Ling et al. | 439/541.5 |
| 2007/0237464 | A1 * | 10/2007 | Aronson et al. | 385/89 |
| 2007/0237472 | A1 * | 10/2007 | Aronson et al. | 385/101 |
| 2008/0069052 | A1 * | 3/2008 | Mezer et al. | 370/332 |
| 2008/0150546 | A1 * | 6/2008 | Gale | 324/538 |
| 2008/0249470 | A1 * | 10/2008 | Malave et al. | 604/151 |
| 2008/0267620 | A1 * | 10/2008 | Cole et al. | 398/17 |
| 2009/0060425 | A1 * | 3/2009 | Aronson | 385/88 |
| 2009/0093137 | A1 | 4/2009 | Badehi et al. | |
| 2009/0093166 | A1 * | 4/2009 | Fogg et al. | 439/660 |
| 2009/0232151 | A1 * | 9/2009 | Furlong et al. | 370/419 |
| 2009/0247006 | A1 * | 10/2009 | Thompson | 439/527 |
| 2010/0014566 | A1 * | 1/2010 | Mezer et al. | 375/220 |
| 2011/0123157 | A1 * | 5/2011 | Belsan et al. | 385/75 |
| 2012/0015552 | A1 * | 1/2012 | Diab et al. | 439/488 |
| 2012/0057821 | A1 * | 3/2012 | Aronson et al. | 385/39 |

OTHER PUBLICATIONS

IEEE Standard 802.3an-2006, "IEEE Standard for Information technology—Telecommunications and information exchange between systems—Local and metropolitan area networks—Specific requirements; Part 3: Carrier Sense Multiple Access with Collision Detection (CSMA/CD) Access Method and Physical Layer Specifications; Amendment 1: Physical Layer and Management Parameters for 10 Gb/s Operation, Type 10GBASE-T", Sep. 1, 2006.

SFF Committee, "SFF-8436 Specification for QSFP+ Copper and Optical Modules", Revision 3.4, Nov. 12, 2009.

SFF Committee, "SFF-8431 Specifications for Enhanced Small Form Factor Pluggable Module SFP+", Revision 4.1 Jul. 6, 2009.

Solarflare Communications, Inc., "Solarflare SFN5122F Dual-Port 10G Ethernet Enterprise Server Adapter", Product Brief, year 2011.

Teranetics-PLX Technology, Inc., "Dual-Speed 10GBase-T / 1000 Base-T Ethernet Physical Layer Device", Product Brief, year 2010.

* cited by examiner

ADAPTER FOR HIGH-SPEED ETHERNET

CROSS-REFERENCE TO RELATED APPLICATION

This application claims the benefit of U.S. Provisional Patent Application 61/383,343, filed Sep. 16, 2010, which is incorporated herein by reference.

FIELD OF THE INVENTION

The present invention relates generally to data communications, and specifically to adapters for bridging between connectors of different types.

BACKGROUND

Small Form-factor Pluggable (SFP) modules are used in various telecommunication and data networking applications to interface between a printed circuit board in a network device and a network cable (which may be electrical or fiberoptic). Typically, the SFP receptacle is mounted on the printed circuit board with appropriate electrical connections to the circuit traces on the board, and a connector at the end of the cable plugs into the receptacle. The connector itself commonly contains signal conversion circuitry and is therefore referred to as a "transceiver."

The mechanical and electrical characteristics of various SFP modules have been defined by industry organizations. For example, the SFP+ specification defines hot-pluggable modules that may be used at data rates up to 10 Gb/s. Details of these modules have been set forth by the SFF Committee in the *SFF*-8431 *Specifications for Enhanced Small Form Factor Pluggable Module SFP+* (Revision 4.1, Jul. 6, 2009), which is incorporated herein by reference. This specification, as well as other SFP specifications, is available at ftp.seagate-.com/sff.

Quad Small Form-factor Pluggable (QSFP) modules are used in similar applications to the SFP modules described above and support four parallel communication channels at 10 Gb/s. The mechanical and electrical characteristics of QSFP modules are described in the *SFF*-8436 *Specification for QSFP+ Copper and Optical Modules* (Revision 3.4, November, 2009), which is also incorporated herein by reference.

U.S. Pat. No. 7,335,033, whose disclosure is incorporated herein by reference, describes a form factor converter configured to concurrently connect to a circuit board module and a small form factor transceiver. The form factor converter includes an exterior portion defining a large form factor to fit within the device mounting section of the circuit board module, and an interior portion defining a small form factor location to receive at least a portion of a small form factor transceiver.

U.S. Pat. No. 7,934,959, whose disclosure is incorporated herein by reference, describes an adapter, which includes a mechanical frame, which is configured to be inserted into a four-channel SFP receptacle and to receive inside the frame a single-channel SFP cable connector. First electrical terminals, held by the mechanical frame, are configured to mate with respective first pins of the receptacle. Second electrical terminals, held within the mechanical frame, are configured to mate with respective second pins of the connector. Circuitry couples the first and second electrical terminals so as to enable communication between the connector and one channel of the receptacle while terminating the remaining channels of the receptacle.

10 GBASE-T Ethernet is a standard defined by IEEE 802.3an-2006, which is incorporated herein by reference. This standard provides connections at 10 Gb/s over unshielded or shielded twisted pair cables, over distances up to 100 meters. 10 GBASE-T can use the same cable infrastructure as legacy standards, such as 1000BASE-T, including Category 6 (or better) cabling and RJ45 connectors. It thus allows a gradual upgrade from 1000BASE-T using autonegotiation to select which speed to use. The features of 10 GBASE-T are described in detail by Barrass, et al., in a white paper entitled, "10 GBASE-T: 10 Gigabit Ethernet over Twisted-pair Copper," published by the Ethernet Alliance (Austin, Tex., Version 1.0, August, 2007), which is available at www.teranetics.com/pdf/EA_10GBase-T-Overview.pdf and is incorporated herein by reference.

SUMMARY

Embodiments of the present invention that are described hereinbelow provide adapters and methods for interworking of connectors and cables defined by different protocols and specifications.

There is therefore provided, in accordance with an embodiment of the present invention, an adapter, including a mechanical frame, which is configured to be inserted into a SFP-type receptacle and contains a socket for receiving a plug of a twisted-pair-type cable. First electrical terminals are held by the mechanical frame and configured to mate with a connector in the receptacle. Second electrical terminals are held within the socket and configured to mate with electrical connections of the plug. Circuitry connects the first and second electrical terminals so as to enable interoperation of the plug with the receptacle.

In a disclosed embodiment, the plug is a RJ45 plug, and the SFP-type receptacle is selected from a group of receptacles consisting of QSFP, QSFP+ and SFP+ receptacles.

In some embodiments, the connector in the receptacle is an edge connector, and the circuitry includes a printed circuit board, and the first electrical terminals are located at an end of the printed circuit board and are configured to mate with the edge connector.

Typically, the circuitry includes at least one integrated circuit. In a disclosed embodiment, the at least one integrated circuit is configured to convert between a single-lane signal on the first electrical terminals and a multi-lane signal on the second electrical terminals.

Additionally or alternatively, the circuitry may be configured to convert between a 10 GBASE-R interface of the receptacle and a 10 GBASE-T interface of the plug.

There is also provided, in accordance with an embodiment of the present invention, a method for communication, which includes inserting an adapter into a SFP-type receptacle. The adapter includes a mechanical frame, first and second electrical terminals, and circuitry enabling interoperation of the plug with the receptacle, as described above. The plug of the twisted-pair-type cable is inserted into the socket.

The present invention will be more fully understood from the following detailed description of the embodiments thereof, taken together with the drawings in which:

DETAILED DESCRIPTION OF EMBODIMENTS

Many types of high-speed network equipment, such as switches and advanced network interface cards, have SFP receptacles for connection of cables to other equipment. It would be desirable to enable such equipment to accept RJ45 connectors, as well, and thereby be able to communicate over standard twisted pair cables directly with 10GBASE-T equipment. Embodiments of the present invention therefore provide adapters that fit inside an SFP receptacle (such as QSFP, QSFP+ or SFP+) and accommodate a RJ45 plug, both mechanically and electrically, thus enabling cables that are terminated with RJ45 plugs to be plugged into SFP receptacles.

Although the embodiments that are described hereinbelow relate specifically to interworking of SFP+ with QSFP with RJ45 plugs, the principles of the present invention may similarly be applied in mating other heterogeneous types of plugs and receptacles.

Figure 1:
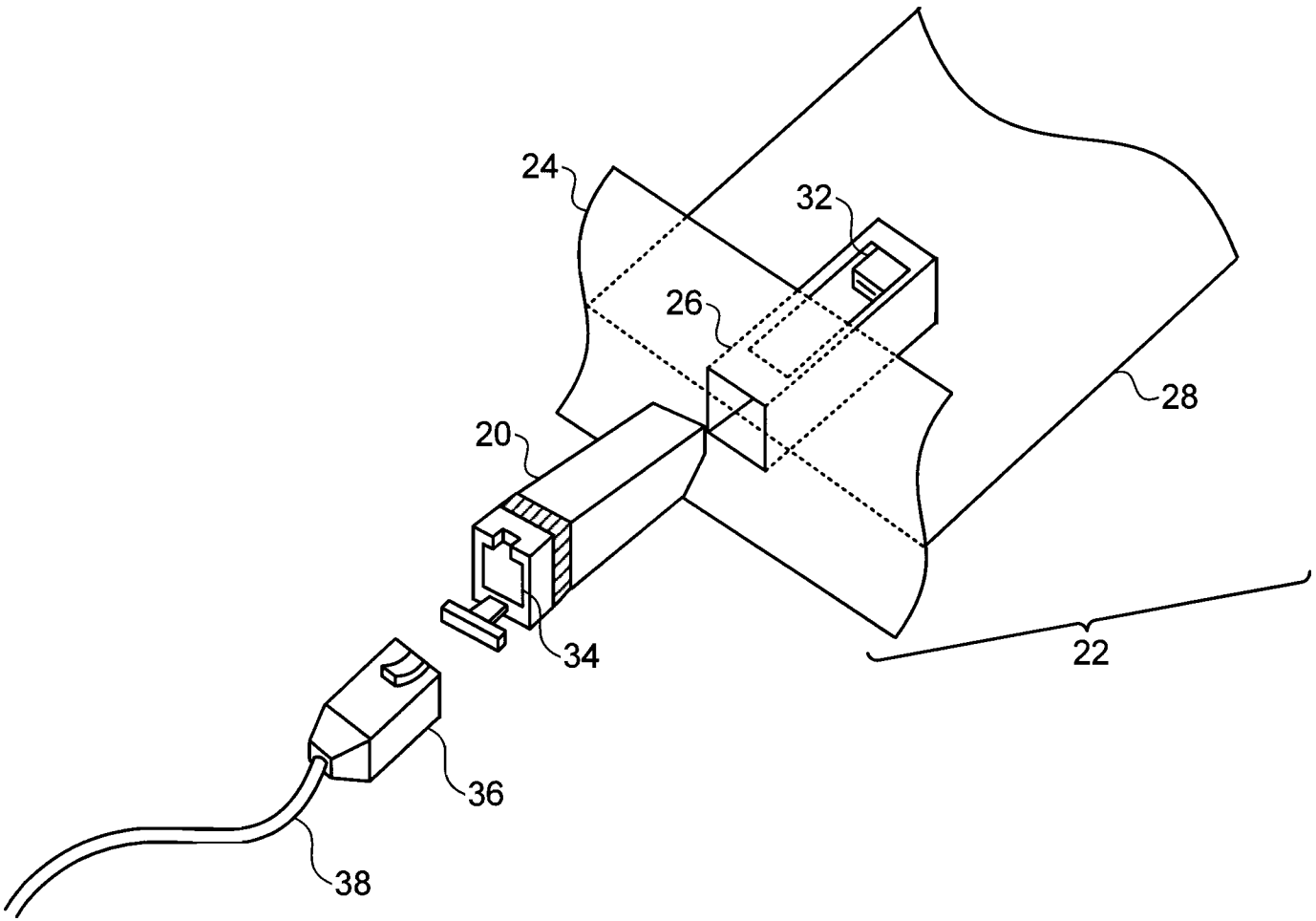
FIG. 1 is a schematic, pictorial illustration showing connection of an Ethernet cable to a SFP+ receptacle via an adapter, in accordance with an embodiment of the present invention.
Figure 2A:
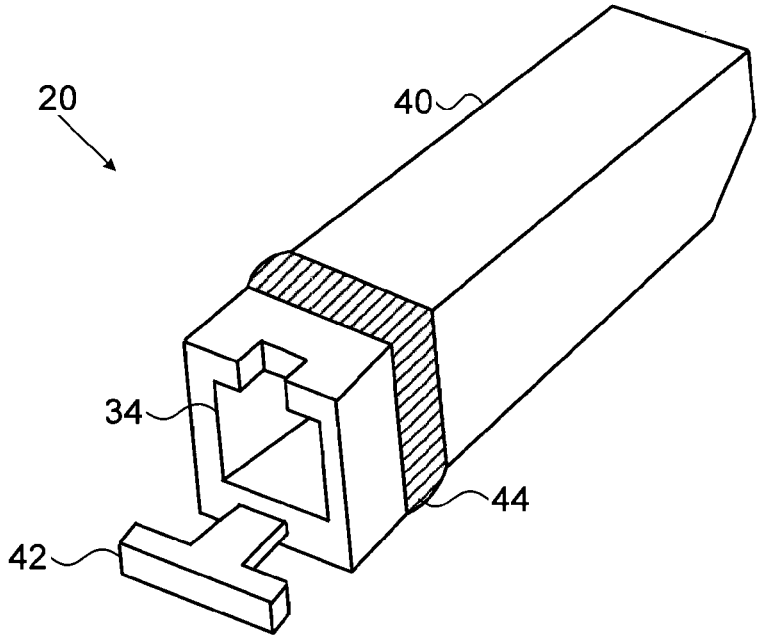
FIGS. 2A and 2B are schematic, pictorial views of the adapter of FIG. 1, seen from two different angles.
Figure 2B:
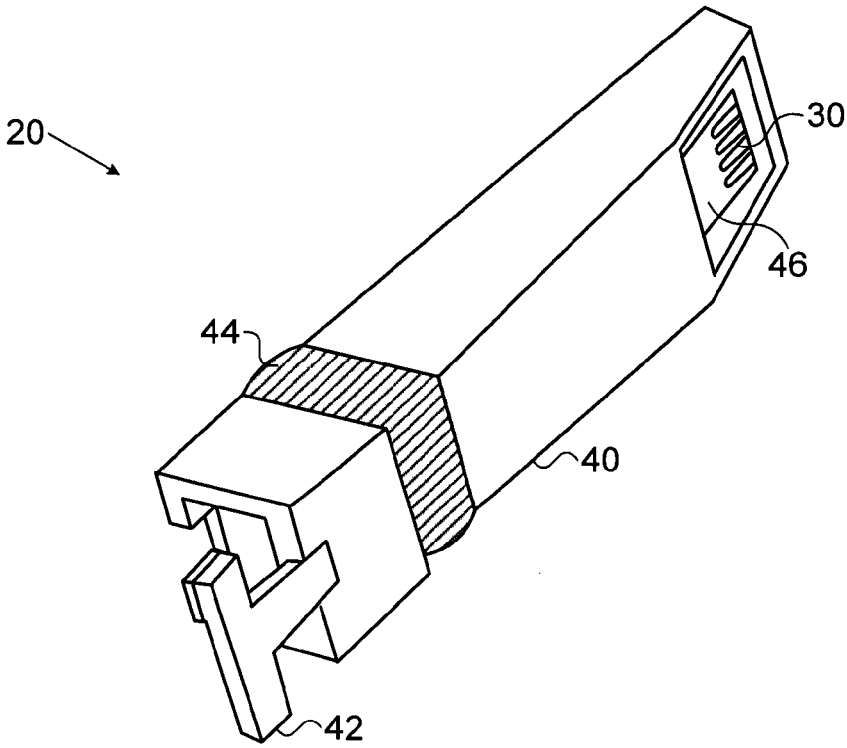

Reference is now made to FIGS. 1, 2A and 2B, which schematically illustrate a SFP+-RJ45 adapter 20, in accordance with an embodiment of the present invention. FIG. 1 shows how adapter 20 is used in connecting an Ethernet cable 38, such as a Category 6 cable, to a piece of network equipment 22. FIGS. 2A and 2B show details of adapter 20 from two different angles.

Adapter 20 is plugged into a SFP+ receptacle 26 in a panel 24 of equipment 22. (Typically, panel 24 contains multiple receptacles with respective indicator lamps and other controls, as are known in the art, but only a single receptacle is shown here for the sake of simplicity). Receptacle 26 could simply receive a cable with a SFP+ plug (not shown). In some cases, however, it may be desired to couple equipment 22 to legacy equipment that contains only RJ45 sockets, for example, or it may be desired to use legacy twisted-pair cables instead of more costly twin-ax copper or fiberoptic cables that are commonly used with SFP+ transceivers. For these sorts of cases, adapter 20 permits cable 38 with a RJ45 connector 36 to mate with receptacle 26. A release mechanism, such as a pull tab 42 or a lever, can be used to remove the adapter from the receptacle when it is no longer needed.

Receptacle 26 comprises a cage, which is mounted on a printed circuit board 28 behind panel 24. Adapter 20 comprises a mechanical frame 40 having outer dimensions that are similar or identical to those of a standard SFP+ connector and thus fits into the cage. Outer electrical terminals 30 on adapter 20 mate with an edge connector 32 in receptacle 26 in the same manner as would the terminals of a SFP+ connector. Terminals 30 are located at the end of a miniature printed circuit board 46 inside frame 40. A collar 44 holds adapter 20 in place and provides a continuous ground connection to frame 40 when the adapter is inserted into receptacle 26.

At the outer end of adapter 20, opposite terminals 30, the adapter comprises a socket 34 which has inner dimensions and internal connections that are identical to those of a RJ45 socket and can thus receive RJ45 plug 36. The connections in socket 34 connect to circuit board 46. Circuits on board 46 convert 10 Gigabit Ethernet from the GBASE-R PCS (physical coding sublayer) and PMA (physical medium attachment) components of the physical layer interface (PHY) that are provided by receptacle 26 to the 10 GBASE-T PCS, PMA, and PMD (physical medium dependent) PHY components accepted by plug 36, and vice versa.

Figure 3:
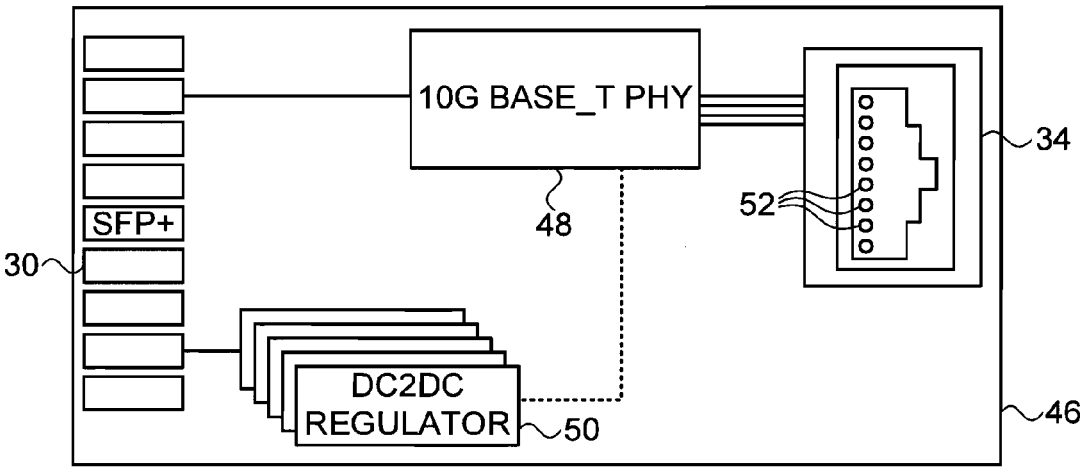
FIG. 3 is a block diagram that schematically shows electrical components of an SFP+-RJ45 adapter, in accordance with an embodiment of the present invention.

FIG. 3 is a block diagram that schematically shows electrical components of SFP+-RJ45 adapter 20, in accordance with an embodiment of the present invention. The adapter includes an integrated circuit (IC) 48 (or a number of such circuits), connected between SFP+ terminals 30 and RJ45 terminals 52 in socket 34. Circuit 48 converts between the single-lane 10 GBASE-R PHY that is provided to receptacle 26 at edge connector 32 and the four-lane 10 GBASE-T PHY that is used on cable 38. The conversion includes the PMD, PMA and PCS components of the Ethernet PHY. ICs capable of performing this sort of conversion are commercially available and include, for example, the AQ1103 PHY Transceiver produced by Aquantia (Milpitas, Calif.), as well as similar products offered by Solarflare Communications (Irvine, Calif.) and Teranetics (San Jose, Calif.). Electrical power at the voltage levels required by circuit 48 is provided by a power conversion circuit 50, including one or more DC/DC converters and regulators.

Thus, adapter 20 appears to equipment 22 to be a standard SFP+ transceiver, which accepts and outputs signals on terminals 30 that are compatible with a standard 10 GBASE-R PHY. At the same time, the adapter appears to cable 38 to be a standard 10 GBASE-T interface, with a 10 GBASE-T PHY and socket 34. In this manner, adapter 20 permits interworking of the SFP+ receptacle with the RJ45 plug.

Figure 4A:
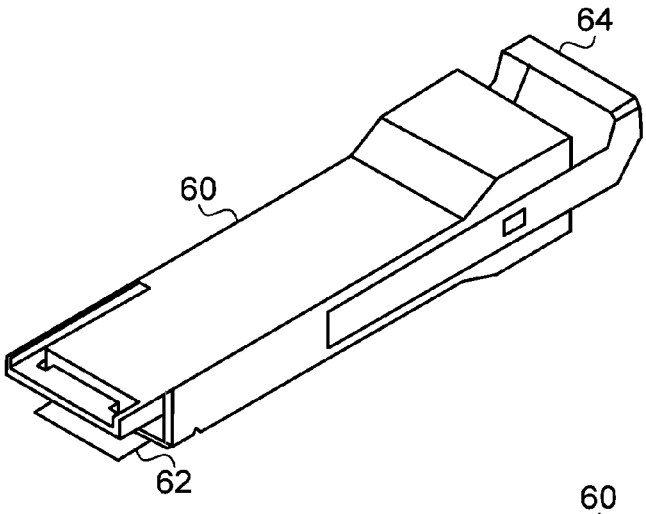
FIGS. 4A and 4B are schematic, pictorial views of a QSFP-RJ45 adapter, seen from two different angles, in accordance with another embodiment of the present invention.
Figure 4B:
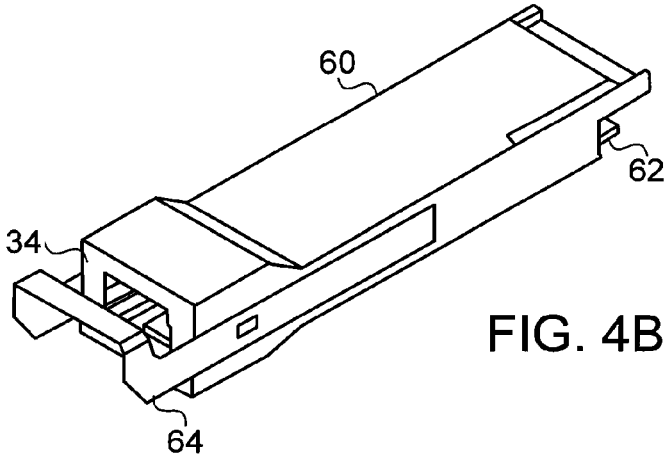

Reference is now made to FIGS. 4A and 4B, which schematically show two different schematic, pictorial views of a QSFP-RJ45 adapter 60, in accordance with another embodiment of the present invention. The features of adapter 60 are similar to those of adapter 20 described above, including terminals 62, a pull-lever 64, and socket 34, but are dimensioned for insertion into a slightly larger QSFP receptacle (not shown), with a 4×10 Gb/s interface and different pin definitions.

Figure 5:
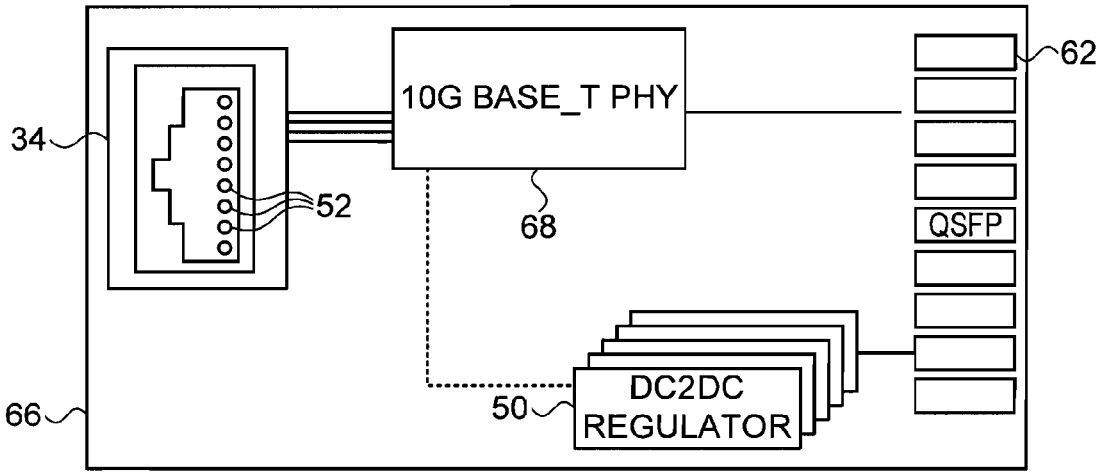
FIG. 5 is a block diagram that schematically shows electrical components of an QSFP-RJ45 adapter, in accordance with an embodiment of the present invention.

FIG. 5 is a block diagram that schematically shows electrical components of QSFP-RJ45 adapter 60, in accordance with an embodiment of the present invention. As in the preceding embodiment, adapter 60 comprises at least one integrated circuit 68, which is mounted on a miniature printed circuit board 66 and is connected between QSFP terminals 62 and RJ45 terminals 52 in socket 34. Circuit 68 typically converts between single-lane 10 GBASE-R or 10 GBASE-X PHY signals on terminals 62 and the four-lane 10 GBASE-T signals on terminals 52.

Alternatively, adapter 60 may be configured to handle 40 Gigabit Ethernet signals, and thus convert between 40 GBASE-R and 40 GBASE-T formats (with a suitable connector and cable to handle the 40 Gb/s data rate). In this case, the PHY IC on the adapter is configured for 40 Gb/s operation and has four lanes on both the 40 GBASE-R side and the 40 GBASE-T side.

Although the above figures show particular implementations of the mechanical and electrical connections used in adapters 20 and 60, variations on these implementations will be apparent to those skilled in the art, after reading the above disclosure. Such variations are considered to be within the scope of the present invention. More generally, the principles of the present invention may similarly be applied in adapting other SFP-type receptacles to mate with standard network cable plugs.

It will thus be appreciated that the embodiments described above are cited by way of example, and that the present invention is not limited to what has been particularly shown and described hereinabove. Rather, the scope of the present invention includes both combinations and subcombinations of the various features described hereinabove, as well as variations and modifications thereof which would occur to persons skilled in the art upon reading the foregoing description and which are not disclosed in the prior art.

The invention claimed is:

1. An adapter, comprising:

a mechanical frame, which is configured to be inserted into a SFP-type receptacle and contains a socket for receiving a plug of a twisted-pair-type cable;

first electrical terminals, held by the mechanical frame and configured to mate with a connector in the receptacle so as to transmit and receive first signals to and from the connector in a first signal format;

second electrical terminals, held within the socket and configured to mate with electrical connections of the plug so as to transmit and receive second signals to and from the plug in a second signal format, different from the first signal format; and circuitry connecting the first and second electrical terminals and comprising at least one integrated circuit, which is contained within the mechanical frame and is configured to convert between the first and second signal formats so as to enable interoperation of the plug with the receptacle.

2. The adapter according to claim 1, wherein the plug is a RJ45 plug.

3. The adapter according to claim 2, wherein the SFP-type receptacle is selected from a group of receptacles consisting of QSFP, QSFP+ and SFP+ receptacles.

4. The adapter according to claim 1, wherein the connector in the receptacle is an edge connector, and wherein the circuitry comprises a printed circuit board, and wherein the first electrical terminals are located at an end of the printed circuit board and are configured to mate with the edge connector.

5. The adapter according to claim 1, wherein the at least one integrated circuit is configured to convert between a single-lane signal on the first electrical terminals and a multi-lane signal on the second electrical terminals.

6. The adapter according to claim 1, wherein the circuitry is configured to convert between a 10 GBASE-R interface of the receptacle and a 10 GBASE-T interface of the plug.

7. A method for communication, comprising:

inserting an adapter into a SFP-type receptacle, the adapter comprising:

a mechanical frame, which is configured to be inserted into the receptacle and contains a socket for receiving a plug of a twisted-pair-type cable;

first electrical terminals, held by the mechanical frame and configured to mate with a connector in the receptacle so as to transmit and receive first signals to and from the connector in a first signal format;

second electrical terminals, held within the socket and configured to mate with electrical connections of the plug so as to transmit and receive second signals to and from the plug in a second signal format, different from the first signal format; and circuitry connecting the first and second electrical terminals and comprising at least one integrated circuit, which is contained within the mechanical frame and is configured to convert between the first and second signal formats so as to enable interoperation of the plug with the receptacle; and inserting the plug of the twisted-pair-type cable into the socket.

8. The method according to claim 7, wherein the plug is a RJ45 plug.

9. The method according to claim 8, wherein the SFP-type receptacle is selected from a group of receptacles consisting of QSFP, QSFP+ and SFP+ receptacles.

10. The method according to claim 7, wherein the connector in the receptacle is an edge connector, and wherein the circuitry comprises a printed circuit board, and wherein the first electrical terminals are located at an end of the printed circuit board, and wherein inserting the adapter comprises inserting the end of the printed circuit board into the edge connector.

11. The method according to claim 7, and comprising converting, using the at least one integrated circuit, between a single-lane signal on the first electrical terminals and a multi-lane signal on the second electrical terminals.

12. The method according to claim 7, and comprising converting, using the circuitry, between a 10 GBASE-R interface of the receptacle and a 10 GBASE-T interface of the plug.

* * * * *